US009316096B2

(12) United States Patent
Bang et al.

(10) Patent No.: US 9,316,096 B2
(45) Date of Patent: Apr. 19, 2016

(54) ENHANCED OIL RECOVERY SCREENING MODEL

(75) Inventors: Vishal Bang, Houston, TX (US); Jing Peng, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 323 days.

(21) Appl. No.: 13/297,355

(22) Filed: Nov. 16, 2011

(65) Prior Publication Data

US 2012/0150519 A1 Jun. 14, 2012

Related U.S. Application Data

(60) Provisional application No. 61/422,024, filed on Dec. 10, 2010.

(51) Int. Cl.
*G06G 7/48* (2006.01)
*E21B 43/16* (2006.01)

(52) U.S. Cl.
CPC ..... *E21B 43/16* (2013.01)

(58) Field of Classification Search
CPC ..... E21B 43/00; E21B 43/24; E21B 43/16; G06G 7/48
USPC ..... 703/10; 702/6
See application file for complete search history.

(56) References Cited

U.S. PATENT DOCUMENTS 6,904,366 B2 6/2005 Patzek et al.
2006/0046948 A1 3/2006 Tang et al.
2007/0168170 A1 7/2007 Thomas
2008/0162100 A1 7/2008 Landa
2009/0012765 A1 1/2009 Raphael
2009/0114387 A1 5/2009 Szabo et al.
2010/0236783 A1 9/2010 Nenniger et al.
2010/0300682 A1* 12/2010 Thakur et al. ..... 703/10
2012/0053920 A1* 3/2012 Rai et al. ..... 703/10

OTHER PUBLICATIONS

Shankar et al. "Enzymatic Hydrolysis in Conjunction with Conventional Pretreatments to Soybean for Enhanced Oil Availability and Recovery"., 1997 AOCS Press. p. 1543-1547.*
Alkafeef, "Review of and Outlook for Enhanced Oil Recovery Techniques in Kuwait Oil Reservoirs" IPTC 11234-MS (2007).
Dickson, et al. "Development of Improved Hydrocarbon Recovery Screening Methodologies" SPE 129768-MS (2010).
Doll, Polymer Mini-Injectivity Test: Shannon Reservoir, Naval Petroleum Reserve No. 3, Natrona County, WY, SPE 12925-MS (1984).
Ibatullin, "SAGD Performance Improvement in Reservoirs With High Solution Gas-Oil Ratio." Oil & Gas Business, http://www.ogbus.ru/eng/ (2009).
Lewis, et al., "Sweep Efficiency of Miscible Floods in a High-Pressure Quarter-Five-Spot Model." SPE J.13 (4):432-439. SPE-102764-PA (2008).

(Continued)

*Primary Examiner* — Eunhee Kim
(74) *Attorney, Agent, or Firm* — ConocoPhillips Company

(57) ABSTRACT

This invention relates to enhanced oil recovery methods to improve hydrocarbon reservoir production. An enhanced oil recovery screening model has been developed which consists of a set of correlations to estimate the oil recovery from miscible and immiscible gas/solvent injection ($CO_2$, $N_2$, and hydrocarbons), polymer flood, surfactant polymer flood, alkaline-polymer flood and alkaline surfactant-polymer flood.

5 Claims, 6 Drawing Sheets

(56) References Cited

OTHER PUBLICATIONS

Munroe, "Solvent Based Enhanced Oil Recovery for In-Situ Upgrading of Heavy Oil Sands." Oil & Natural Gas Technology , DOE Award No. DE-FG26-06NT42745 (2009).
Poellitzer, et al., "Revitalising a Medium Viscous Oil Field by Polymer Injection, Pirawarth Field, Australia" SPE 120991-MS (2009).
Schneider, et al., "A Miscible WAG Protect Using Horizontal Wells in a Mature Offshore Carbonate Middle East Reservoir" SPE93606-MS (2005).
Taber, et al., "EOR Screening Criteria Revisited—Part 1: Introduction to Screening Criteria and Enhanced Recovery Field Projects." SPE Reservoir Engineering, 12: 189-198 (1997).
Tapias, et al., "Reservoir Engineer and Artificial Intelligence Techniques for Data Analysis" SPE 68743-MS (2001).
Wilkinson, et al., "Use of CO2 Containing Impurities for Miscible Enhanced 011 Recovery" Jana Leahy-Dios, Garj F. Telelzke. Jasper L. Dickson. ExxonMobil Upstream Research Company, SPE 131003-MS (2010).
Zabid et al, "A Review on Microbial Enhanced Oil Recovery with Special Reference to Marginal/Uneconomical Reserves" SPE 107052-MS (2007).
Taber et al, "EOR Screening Criteria Revisited—Part 2: Applications and Impact of Oil Prices" SPE Reservoir Engineering, 12: 199-205 (1997).
PCT/US2011/060976 PCT International Search Report and Written Opinion (Form PCT/ISA/220) Dated May 2, 2013.

* cited by examiner

ENHANCED OIL RECOVERY SCREENING MODEL

CROSS-REFERENCE TO RELATED APPLICATIONS

This application is a non-provisional application which claims benefit under 35 USC §119(e) to U.S. Provisional Application Ser. No. 61/422,024 filed Dec. 10, 2010, entitled "Enhanced Oil Recovery Screening Model," which is incorporated herein in its entirety.

STATEMENT REGARDING FEDERALLY SPONSORED RESEARCH

None.

FIELD OF THE INVENTION

This invention relates to enhanced oil recovery methods to improve hydrocarbon reservoir production.

BACKGROUND OF THE INVENTION

Enhanced Oil Recovery (EOR) is a generic term for techniques used to increase hydrocarbon production, including crude oil, natural gas, bitumen, or other hydrocarbon material, from a subterranean reservoir. Using EOR, hydrocarbon production can be dramatically increased over primary and secondary production techniques. The optimal application of EOR type depends on reservoir temperature, pressure, depth, net pay, permeability, residual oil and water saturations, porosity and fluid properties such as oil API gravity and viscosity. As EOR technology develops, there are more techniques available and they are being used on a wider range of reservoir types. Identifying the appropriate EOR for one or more reservoirs becomes difficult and EOR processes can be very expensive.

TABLE 1

Identifying an appropriate EOR process

| Methods/Tools | Limitations/Assumptions |
|---|---|
| Taber's classification | Gives only a broad range of properties over which the EOR method can be applied but does not give any insight into the relative success of different EOR methods if more than one is applicable for a given reservoir. Property ranges not representative of current technology. |
| Wood's, Rai's Models | More input needed to screen reservoirs than what is generally available, developed for 1D-2D models |
| Arco Miscible Flooding Tool | Limited to miscible flooding, Requires expected volumetric sweep efficiencies, in-place and injection fluid compositions |
| Kinder Morgan Tool | Limited to $CO_2$ flooding, black oil based, need dimensionless curves to estimate recovery factors |
| DOE Master | Black oil type property, Todd-Longstaff type displacement |
| PRIZE | High level of input for screening purposes |

Existing EOR screening tools either do not capture the important factors or are limited in their application for screening reservoirs. Screening applications must be tailored to specific reservoir characteristics including permeability ranges, viscosity ranges, depth ranges as well as a plethora of other reservoir properties that may or may not be amenable to specific EOR methods.

BRIEF SUMMARY OF THE DISCLOSURE

An enhanced oil recovery screening model has been developed which consists of a set of correlations to estimate the oil recovery from miscible and immiscible gas/solvent injection ($CO_2$, $N_2$, and hydrocarbons), polymer flood, surfactant polymer flood, alkaline-polymer flood and alkaline surfactant-polymer flood. The correlations are developed using the response surface methodology and correlate the oil recovery at different times of injection to the important reservoir, fluid and flood parameters identified for each process. The results of the model have been validated against simulation results using random values of reservoir, fluid and flood properties and field test results for all the processes. The same methodology can be applied for developing screening model for other oil recovery mechanisms such as thermal (steam injection, SAGD and others), microbial EOR, low salinity enhanced recovery and others.

The invention more particularly includes a process for enhancing hydrocarbon production by mechanistic modeling of one or more EOR process in two or more hydrocarbon reservoirs, identifying parameter ranges including a maximum, minimum and median value for the screening parameters, generating one or more 3D sector models using experimental design methods with the parameter ranges identified, simulating the processes for each hydrocarbon reservoir, developing a response surface to correlate oil recovery at different times of EOR with the screening parameters identified, and testing the response surface for each EOR with multiple random simulations. The process may include validation of the EOR screening model against field data from the reservoirs being screened.

The mechanistic modeling can be done using ECLIPSE™, NEXUS®, MERLIN™, MAPLESIM™, SENSOR™, ROXAR TEMPEST™, JEWELSUITE™, UTCHEM™, or a custom simulator to model the three dimensional reservoir.

EOR processes include thermal, gas, chemical, biological, vibrational, electrical, chemical flooding, alkaline flooding, micellar-polymer flooding, miscible displacement, CO2 injection, N2 injection, hydrocarbon injection, steamflood, in-situ combustion, steam, air, steam oxygen, polymer solutions, gels, surfactant-polymer formulations, alkaline-surfactant-polymer formulations, alkaline-polymer injection, microorganism treatment, cyclic steam injection, surfactant-polymer injection, alkaline-surfactant-polymer injection, alkaline-polymer injection, vapor assisted petroleum extraction or vapor extraction (VAPEX), water alternating gas injection (WAG) and steam-assisted gravity drainage (SAGD), warm VAPEX, hybrid VAPEX and combinations thereof.

The response surface is defined using the following equation:

$$Y=A+B_1X_1+B_2X_2\ldots+C_1X_1X_2+C_2X_1X_3+\ldots+D_1X_1^2+D_2X_2^2+\ldots$$

wherein $X_1$, $X_2$ through $X_n$ are available screening parameters, wherein A, $B_i$, $C_i$, through $N_i$ are calculated coefficients for each parameter; and Y is projected oil recovery during EOR.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1:
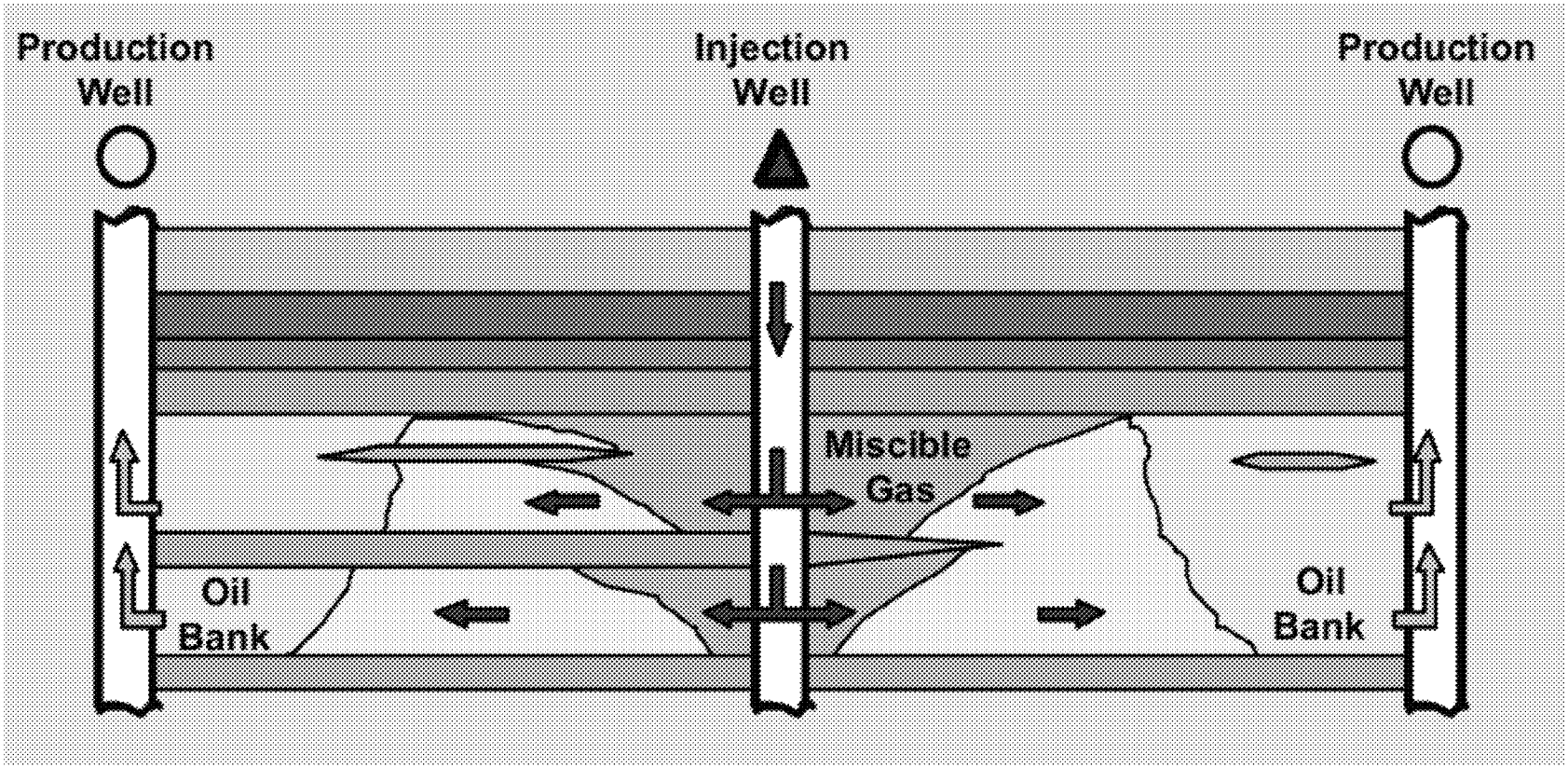
FIG. 1: Miscible/Immiscible Gas Flood ($CO_2$/Hydrocarbon).

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Experimental design as used herein refers to planning an experiment that mimics the actual process accurately while measuring and analyzing the output variables via statistical methods so that objective conclusions can be drawn effectively and efficiently. Experimental design methods attempt to minimize the number of reservoir simulation cases needed to capture all of the desired effects for each of the screening parameters.

Response surface involves fitting an equation to the observed values of a dependent variable using the effects of multiple independent variables. Response surface is used for the EOR screening model, oil recovery at different times of flood is the dependent variable and the screening parameters are the independent variables.

Screening parameters may include: remaining oil saturation (all), residual oil saturation (all), residual water saturation ($CO_2$, HC), oil viscosity/water viscosity ($CO_2$, HC), oil viscosity/gas viscosity ($CO_2$, HC), minimum miscibility pressure/reservoir pressure ($CO_2$, HC), oil viscosity/polymer viscosity (polymer, SP, ASP, AP), Dykstra Parson coefficient, Kz/kx, acid number (AP and ASP), surfactant/alkaline concentration in slug (SP and ASP), chemical slug size (SP, ASP, AP), polymer drive slug size (polymer, SP, ASP, AP), as well as other properties relevant to EOR and reservoir modeling.

In one embodiment the following analysis is conducted:

A) Mechanistic modeling of each studied process to determine the parameters to be used in the EOR screening model, B) Identify the maximum, minimum and median values (ranges) for each selected screening parameter, C) Generate a 3D sector model using experimental design methods, D) Simulate the processes for each respective cases, E) Develop response surfaces to correlate the oil recovery at different times of flood with various screening parameters, and F) Test the response surfaces for each studied process with hundreds of random simulation cases.

Optionally or if available, the EOR screening model may be validated against field data for one or more reservoirs being screened.

Using a parameter based response surface method, the following equation is modeled across a variety of reservoirs.

$$Y=A+B_1X_1+B_2X_2\ldots+C_1X_1X_2+C_2X_1X_3+\ldots+D_1X_1^2+D_2X_2^2\ldots$$

where $X_1, X_2 \ldots X_n$ are available screening parameters ($S_0$, Sorw, $m_0$ etc); A, $B_i$, $C_i$, $D_i$ are calculated coefficients for each parameter; and Y is projected oil recovery during EOR. By varying the values for each parameter, a large number of models may be assessed across each reservoir property.

Abbreviations include enhanced oil recovery (EOR), surfactant-polymer formulations (SP), alkaline-surfactant-polymer formulations (ASP), alkaline-polymer formulations (AP), hydrocarbon (HC), vapor assisted petroleum extraction or vapor extraction (VAPEX), water alternating gas injection (WAG) and steam-assisted gravity drainage (SAGD). Chemical compounds such as carbon dioxide ($CO_2$), nitrogen ($N_2$), and the like will not be reiterated here unless an atypical composition is used.

Enhanced Oil Recovery (EOR) is also known as improved oil recovery or tertiary recovery. EOR methods include thermal, gas, chemical, biological, vibrational, electrical, and other techniques used to increase reservoir production. EOR operations can be broken down by type of EOR, such as chemical flooding (alkaline flooding or micellar-polymer flooding), miscible displacement ($CO_2$ injection or hydrocarbon injection), and thermal recovery (steamflood or in-situ combustion), but some methods include combinations of chemical, miscible, immiscible, and/or thermal recovery methods. Displacement introduces fluids and gases that reduce viscosity and improve flow. These materials could consist of gases that are miscible with oil (including $CO_2$, $N_2$, methane, and other hydrocarbon miscible gases), steam, air or oxygen, polymer solutions, gels, surfactant-polymer formulations, alkaline-surfactant-polymer formulations, alkaline-polymer formulations, microorganism formulations, and combinations of treatments. EOR methods include cyclic steam injection (huff n' puff), WAG, SAGD, VAPEX, warm VAPEX, hybrid VAPEX, and other tertiary treatments. EOR methods may be used in combination either simultaneously where applicable or in series with or without production between treatments. In other embodiments, one EOR method is performed on the reservoir and production resumed. Once production begins to decrease, screening is used to determine if one or more EOR methods are required and cost effective.

Many reservoir simulators are available commercially including ECLIPSE™ from Schlumberger, NEXUS® from Halliburton, MERLIN™ from Gemini Solutions Inc., MAPLESIM™ from Waterloo Maple Inc., SENSOR™ from Coats Eng., ROXAR TEMPEST™ developed by Emerson, STARS™ by CMG, and the self titled JEWELSUITE™, among many others. Additionally, many companies and universities have developed specific reservoir simulators each with unique attributes and capabilities. In one embodiment a custom reservoir simulator was used to generate 3D models for simulating black oil and compositional problems in single-porosity reservoirs. The reservoir simulator may also be used to develop the EOR screening models for miscible/immiscible $CO_2$ flood and miscible/immiscible hydrocarbon/$N_2$ flood. In another embodiment, a 3D compositional reservoir simulator (like UTCHEM™ developed by University of Texas at Austin), was used to develop the EOR screening models for polymer flood, surfactant-polymer flood, alkaline-polymer flood and alkaline-surfactant-polymer flood. In yet another embodiment, the STARS™ modeling tools may be utilized to generate 3D models for a thermal stimulation.

The following examples of certain embodiments of the invention are given. Each example is provided by way of explanation of the invention, one of many embodiments of the invention, and the following examples should not be read to limit, or define, the scope of the invention.

EXAMPLE 1

In one embodiment, the EOR screening method is used to screen reservoirs for different EOR processes and identify the optimum mechanism for EOR. This method identifies strong EOR candidates from a given set of reservoirs, where one or more reservoirs are available for EOR. Evaluation of uncertainty in reservoir properties on EOR flood performance highlights both EOR methods and/or reservoirs with greater uncertainties. This screening method can be used to identify and model the optimum flood design. The results can be used to perform high level project economic evaluation. The methodology can be applied to develop screening models for other EOR processes, thus the appropriate reservoir/EOR combination can be identified under a diverse set of conditions with a variety of reservoirs and EOR methods available. Cost, risk, uncertainty and value can be compared across the board to identify the best candidate reservoirs and methods of EOR.

Although this method has powerful cross-platform applicability under a variety of conditions, the modeler must understand the properties that are relevant and can be assessed for each reservoir. Using the model for reservoirs where parameters are not well defined can lead to erroneous conclusions. For example, using the method to screen reservoirs that do not have all of the screening parameters may lead to improper conclusions and the method should not be used outside the recommended range of screening parameters. Well completion type may also affect reservoir properties and that should be addressed when screening reservoirs. The type of completion should be accounted for when assembling reservoirs for screening.

Figure 2:
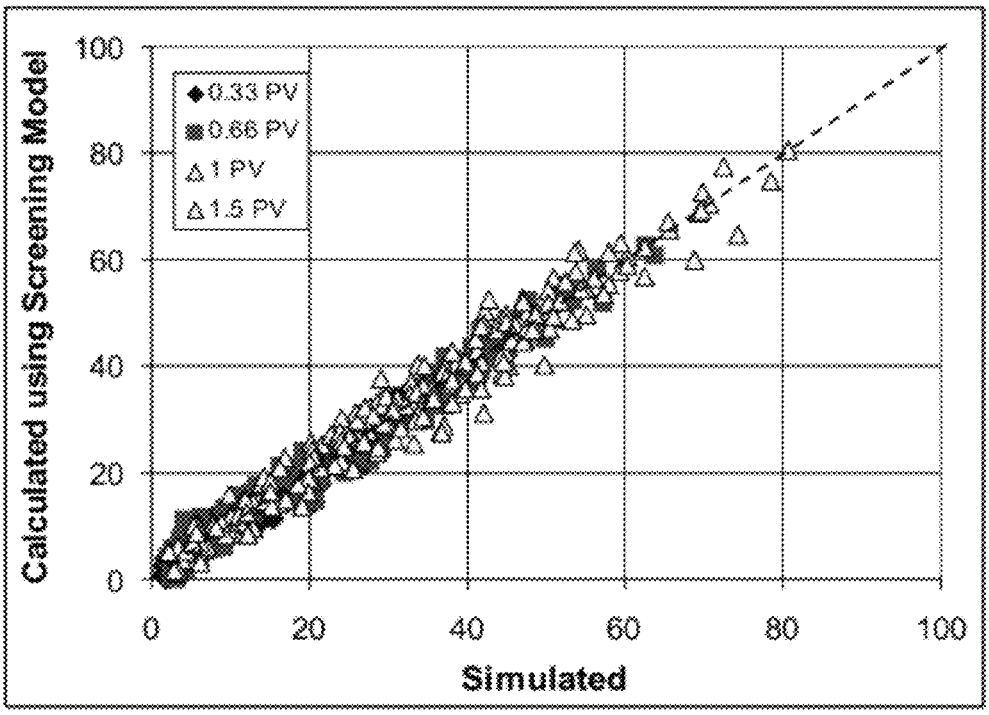
FIG. 2: Comparison of Simulated and Calculated Oil Recovery (% Remaining Oil in Place) for $CO_2$ Flood.

Miscible Gas Flood:

Hundreds of random simulation cases for $CO_2$ flood were run to validate the screening model. The simulated oil recovery at different time of flood was compared with that predicted by the screening model. The results shown in FIG. 2 indicate that the EOR screening model provides a good estimation of oil recovery for $CO_2$ flood.

Figure 3:
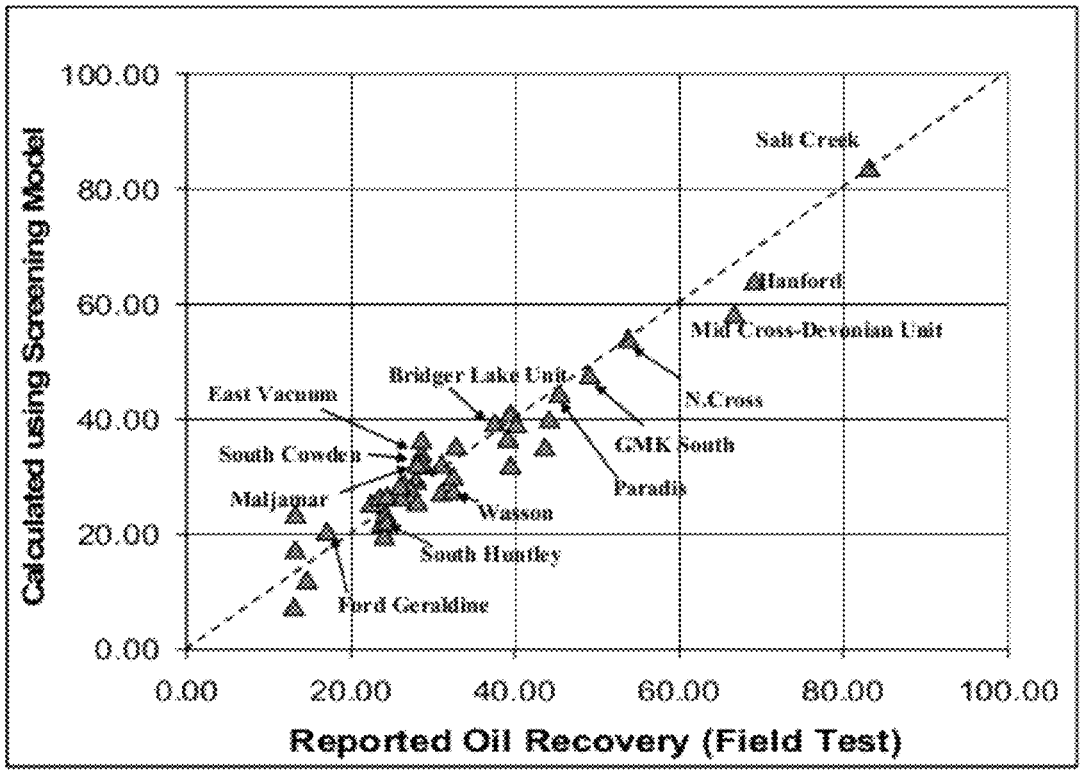
FIG. 3: Comparison of Field Data and Calculated Oil Recovery (% Remaining Oil in Place) for $CO_2$ Flood.

The EOR screening model was validated by field tests of $CO_2$ flood. The reservoir and oil properties of those field tests were input into the screening model and the predicted oil recovery was compared with the actual data. As shown in FIG. 3, the predicted results are very close to the actual oil recovery, indicating that the screening model is a good tool to estimate the oil recovery of $CO_2$ flood.

Figure 4:
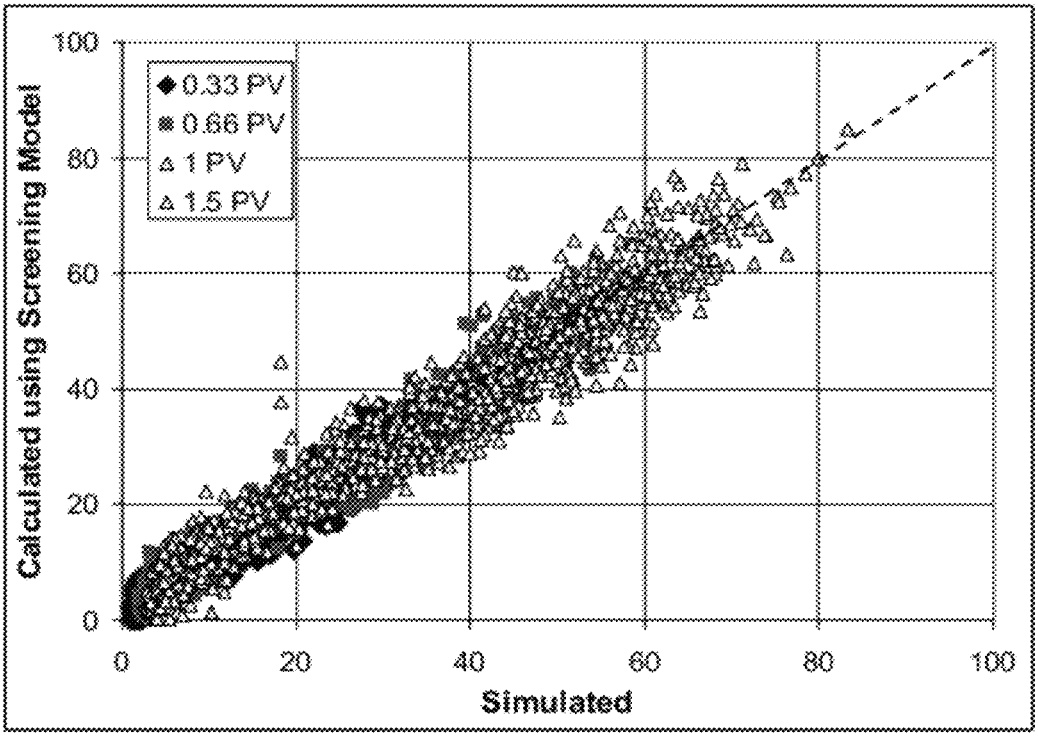
FIG. 4: Comparison of Simulated and Calculated Oil Recovery (% Remaining Oil in Place) for HC flood.

Hydrocarbon Flood:

Hundreds of random simulation cases for hydrocarbon flood were run to test the EOR screening model. The simulated oil recovery at different time of flood was compared with that calculated by the screening model. In FIG. 4, the results demonstrated by the cross-plot suggest that the EOR screening model provides a good estimation of oil recovery for hydrocarbon flood.

Figure 5:
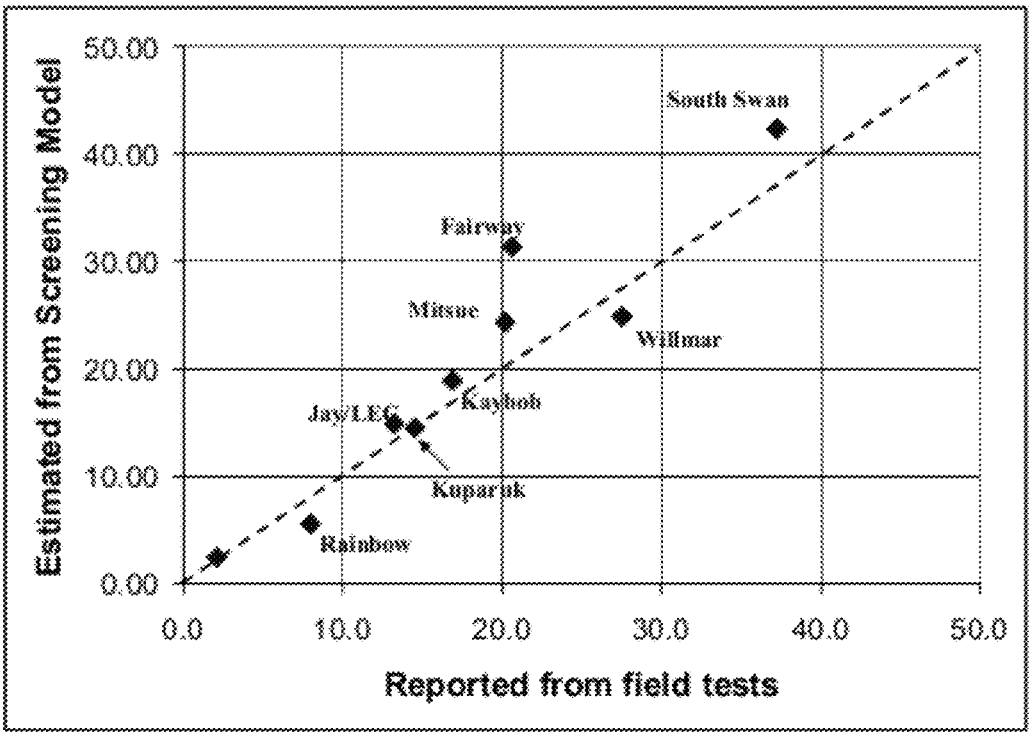
FIG. 5: Comparison of Field Data and Calculated Oil Recovery (% Remaining Oil in Place) for HC Flood

The EOR screening model was validated by field tests of hydrocarbon flood. The reservoir and oil properties of those field tests were input into the screening model and the predicted oil recovery was compared with the actual oil recovery. The results shown in FIG. 5 suggest that the screening model is a good tool to estimate the oil recovery of hydrocarbon flood.

Figure 6:
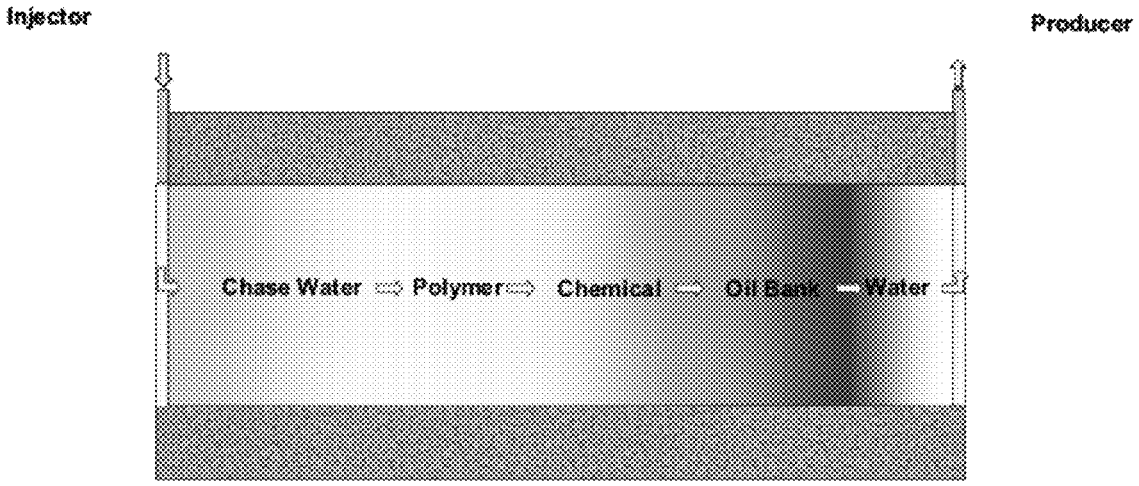
FIG. 6: Chemical EOR

Chemical Flood:

FIG. 6 shows a typical chemical flooding process. The fluid closest to the producer is the remaining water after waterflood. The chemical slug (surfactant-polymer, alkaline-polymer, alkaline-surfactant-polymer, etc.) is responsible for the mobilization of residual oil and mobility control. In an ideal situation, the injected chemical slug creates an oil bank as it moves through the reservoir. A polymer slug follows the chemical slug and provides additional mobility control. The chase water is injected to provide driving force to push all the slugs into the reservoir.

Figure 7:
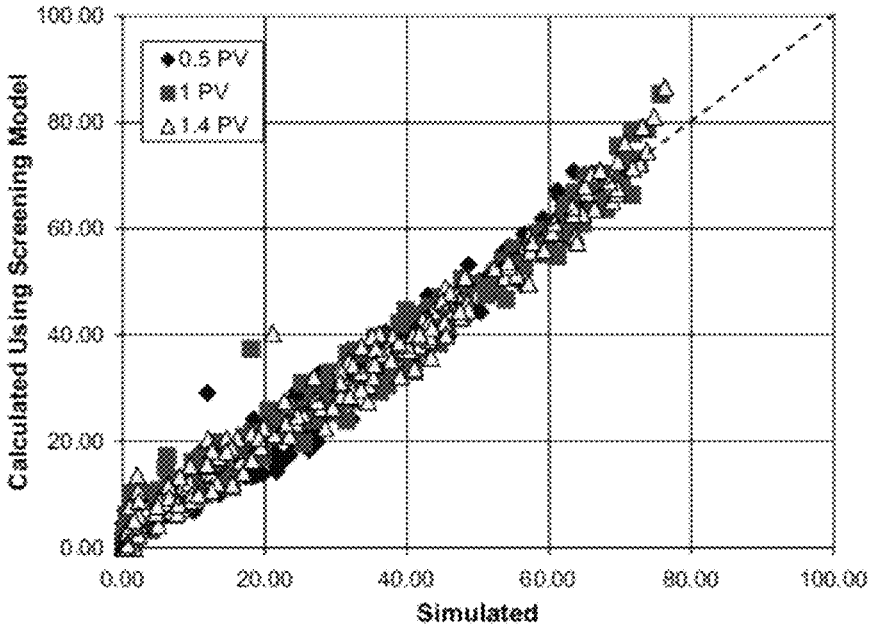
FIG. 7: Comparison of Simulated and Calculated Oil Recovery (% Remaining Oil in Place) for Polymer EOR

In FIG. 7, many random simulation cases for polymer flood were prepared to validate the EOR screening model. The simulated oil recovery at different time of flood was compared with that predicted by the screening model. The results shown in the cross-plot indicate that the EOR screening model provides a good estimation of oil recovery for polymer flood.

Figure 8:
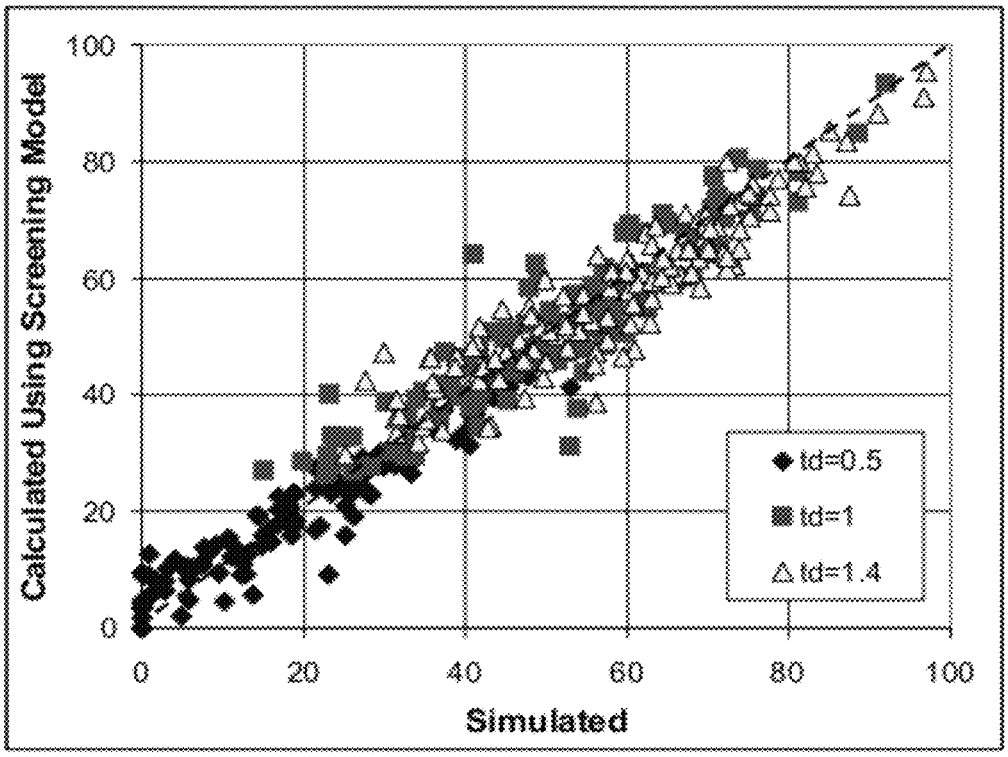
FIG. 8: Comparison of Simulated and Calculated Oil Recovery (% Remaining Oil in Place) for SP EOR

Surfactant-Polymer Flood:

A large number of random simulation cases for surfactant-polymer flood were run to test the EOR screening model. The simulated oil recovery at different time of flood was compared with that calculated by the screening model. The results shown in FIG. 8 suggest that the EOR screening model provides a good estimation of oil recovery for surfactant-polymer flood.

Figure 9:
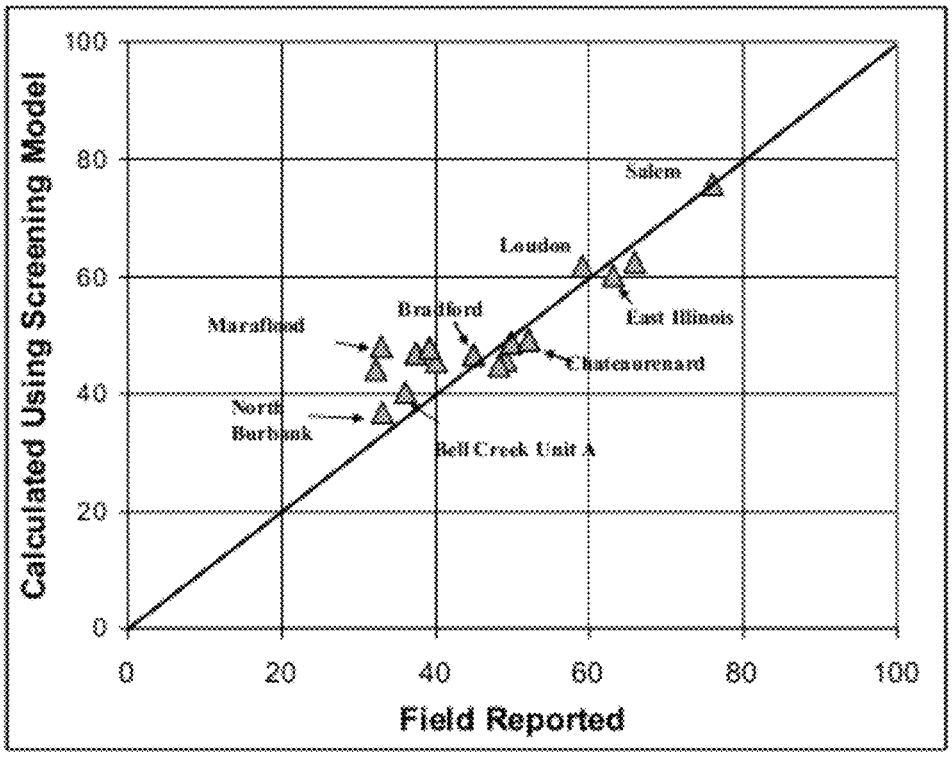
FIG. 9: Comparison of Field Data and Calculated Oil Recovery (% Remaining Oil in Place) for SP Flood

The EOR screening model was validated by surfactant-polymer field tests (FIG. 9). The reservoir, oil and flood properties of those tests were input into the screening model and the estimated oil recovery was compared with the actual oil recovery. The results shown in the cross-plot indicate that the screening model is a good tool to estimate the oil recovery of surfactant-polymer flood.

Figure 10:
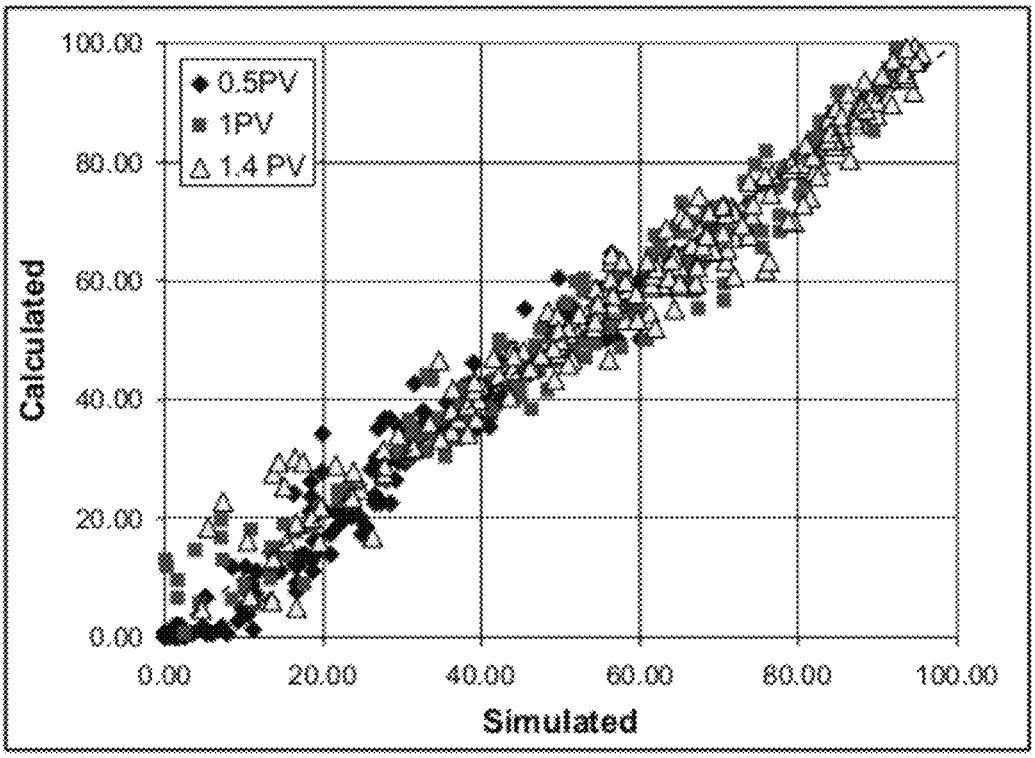
FIG. 10: Comparison of Simulated and Calculated Oil Recovery (% Remaining Oil in Place) for ASP EOR

Alkaline Polymer and Alkaline-Surfactant Polymer Flood:

Hundreds of random simulation cases for alkaline-surfactant-polymer flood were run to validate the EOR screening model. The simulated oil recovery at different time of flood was compared with that predicted by the screening model. The results shown in FIG. 10 indicate that the EOR screening model provides a good estimation of oil recovery for alkaline-surfactant-polymer flood.

Figure 11:
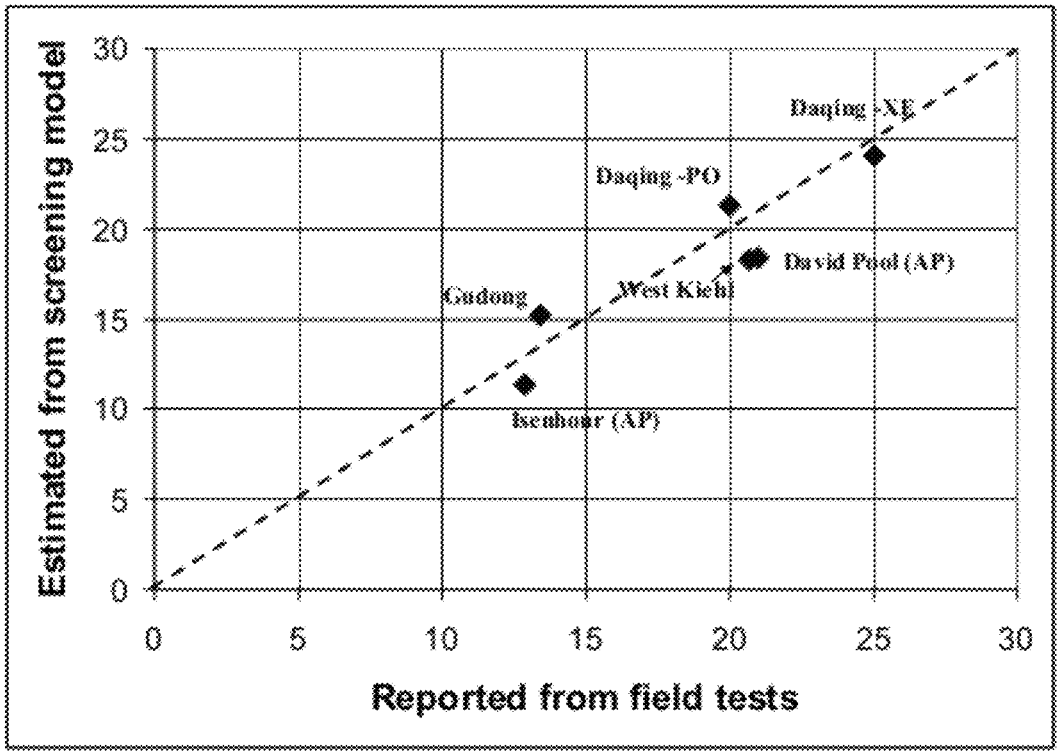
FIG. 11: Comparison of Field Data and Calculated Incremental Oil Recovery over Waterflood for ASP and AP Floods

The EOR screening model was validated by field tests of alkaline-polymer flood and alkaline-surfactant-polymer flood. The reservoir, oil and flood properties of those tests were input into the screening model and the predicted oil recovery was compared with the actual data. As shown in FIG. 11, the predicted results are very close to the actual oil recovery, suggesting that the screening model is a good tool to estimate the oil recovery of alkaline-polymer flood and alkaline-surfactant-polymer flood.

New screening capabilities have been developed for the following EOR methods including: miscible and/or immiscible $CO_2$ flood, miscible and/or immiscible hydrocarbon gas with or without solvent flood, polymer flood, surfactant polymer flood, alkaline-surfactant-polymer (ASP) flood, alkaline-polymer (AP) flood, and other EOR techniques. The developed EOR screening models have been validated against the available field data. This screening method provides the capability of screening multiple reservoirs portfolio to identify the strong EOR candidates and the potential of improving oil recovery in a variety of reservoir conditions.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. Nos. 6,904,366, 7,248,969, US2006122777, Univ. Calif., Patzek (2001).
2. US2006046948, Calif. Inst. Tech., Tang (2004).
3. US2009114387, WO2009061555, Schlumberger Tech. Corp., Horvath (2007).
4. US2010236783, Solv. Corp., Nenniger (2008).
5. Alkafeef, "Review of and Outlook for Enhanced Oil Recovery Techniques in Kuwait Oil Reservoirs" IPTC 11234-MS (2007)
6. Dickson, et al. "Development of Improved Hydrocarbon Recovery Screening Methodologies" SPE 129768-MS (2010)
7. Doll, "Polymer Mini-Injectivity Test: Shannon Reservoir, Naval Petroleum Reserve No. 3, Natrona County, Wyo., SPE 12925-MS (1984)
8. Ibatullin, "SAGD Performance Improvement In Reservoirs With High Solution Gas-Oil Ratio." Oil & Gas Business, http://www.ogbus.ru/eng/ (2009)
9. Lewis, et al., "Sweep Efficiency of Miscible Floods in a High-Pressure Quarter-Five-Spot Model." SPE J.13 (4): 432-439. SPE-102764-PA (2008).
10. Munroe, "Solvent Based Enhanced Oil Recovery for In-Situ Upgrading of Heavy Oil Sands." Oil & Natural Gas Technology, DOE Award No.: DE-FG26-06NT42745 (2009)
11. Poellitzer, et al., "Revitalising a Medium Viscous Oil Field by Polymer Injection, Pirawarth Field, Australia" SPE 120991-MS (2009)
12. Schneider, et al. "A Miscible WAG Project Using Horizontal Wells in a Mature Offshore Carbonate Middle East Reservoir" SPE93606-MS (2005)
13. Taber, et al., "EOR Screening Criteria Revisited—Part 1: Introduction to Screening Criteria and Enhanced Recovery Field Projects." SPE Reservoir Engineering, 12: 189-198 (1997).
14. Taber, et al., "EOR Screening Criteria Revisited—Part 1: Introduction to Screening Criteria and Enhanced Recovery Field Projects." SPE Reservoir Engineering, 12: 199-205 (1997).
15. Tapias, et al., "Reservoir Engineer and Artificial Intelligence Techniques for Data Analysis" SPE 68743-MS (2001)
16. Wilkinson, et al., "Use of $CO_2$ Containing Impurities for Miscible Enhanced 011 Recovery" Jana Leahy-Dios, Garj F. Telelzke. Jasper L Dickson. ExxonMobil Upstream Research Company, SPE 131003-MS (2010)
17. Zahid et al, "A Review on Microbial Enhanced Oil Recovery with Special Reference to Marginal/Uneconomical Reserves" SPE 107052-MS (2007)

The invention claimed is:

1. A process for enhancing hydrocarbon production where the process comprises:

a) mechanistic modeling of one or more enhanced oil recovery process (EOR) in two or more hydrocarbon reservoirs, b) identifying parameter ranges including a maximum, minimum and median value for one or more available screening parameters, c) generating one or more three dimensional reservoir models using experimental design methods with the parameter ranges identified, d) simulating the process for each hydrocarbon reservoir, e) developing a response surface to correlate oil recovery at different times of EOR with one or more available screening parameters, wherein the response surface consists of:

$$Y=A+B_1X_1+B_2X_2\ldots+C_1X_1X_2+C_2X_1X_3+\ldots+D_1X_1^2+D_2X_2^2+\ldots$$

wherein $X_1$, $X_2$ through $X_n$ are available screening parameter, wherein $X_n$ represents the final available screening parameter, wherein A, $B_i$, $C_i$, $D_i$, through $N_i$ are calculated coefficients for each available screening parameter, wherein i represents the available screening parameter, wherein N represents the final coefficients and wherein Y is projected oil recovery during EOR, and f) testing the response surface for each EOR with multiple random simulations.

2. The process of claim 1, wherein an EOR screening model is validated against field data for one or more reservoirs being screened.

3. The process of claim 1, wherein the mechanistic modeling uses one or more reservoir simulators selected from the group consisting of ECLIPSE™, NEXUS®, MERLIN™, MAPLESIM™, SENSOR™, STARS™, ROXAR TEMPEST™, JEWELSUITE™, UTCHEM™, and a custom simulator to generate the three dimensional reservoir model.

4. The process of claim 1, wherein the EOR is selected from the group consisting of thermal, gas, chemical, biological, vibrational, electrical, chemical flooding, alkaline flooding, micellar-polymer flooding, miscible displacement, $CO_2$ injection, $N_2$ injection, hydrocarbon injection, steamflood, in-situ combustion, steam, air, steam oxygen, polymer solutions, gels, surfactant-polymer formulations, alkaline-surfactant-polymer formulations, alkaline-polymer injection, microorganism treatment, cyclic steam injection, surfactant-polymer injection, alkaline-surfactant-polymer injection, alkaline-polymer injection, vapor assisted petroleum extraction or vapor extraction (VAPEX), water alternating gas injection (WAG) and steam-assisted gravity drainage (SAGD), warm VAPEX, hybrid VAPEX and combinations thereof.

5. The process of claim 1, wherein the one or more available screening parameters are selected from the group of screening parameters consisting of: remaining oil saturation (all), residual oil saturation (all), residual water saturation ($CO_2$, HC), oil viscosity/water viscosity ($CO_2$, HC), oil viscosity/gas viscosity ($CO_2$, HC), minimum miscibility pressure/reservoir pressure ($CO_2$, HC), oil viscosity/polymer viscosity (polymer, SP, ASP, AP), Dykstra Parson coefficient, Kz/kx, acid number (AP and ASP), surfactant/alkaline concentration in slug (SP and ASP), chemical slug size (SP, ASP, AP), polymer drive slug size (polymer, SP, ASP, AP).

* * * * *